US005438604A

United States Patent [19]

Horbaschek

[11] Patent Number: 5,438,604

[45] Date of Patent: Aug. 1, 1995

[54] X-RAY DIAGNOSTICS INSTALLATION FOR INTERMITTENT TRANSILLUMINATION

[75] Inventor: Heinz Horbaschek, Erlangen, Germany

[73] Assignee: Siemens Aktiengesellschaft, Munich, Germany

[21] Appl. No.: 280,410

[22] Filed: Jul. 26, 1994

Related U.S. Application Data

[63] Continuation of Ser. No. 32,092, Mar. 17, 1993.

[30] Foreign Application Priority Data

Apr. 15, 1992 [DE] Germany ..... 42 12 644.4

[51] Int. Cl.[6] ..... H05G 1/64

[52] U.S. Cl. ..... 378/98.2; 378/91

[58] Field of Search ..... 378/99, 98.2; 358/111

[56] References Cited

U.S. PATENT DOCUMENTS 4,017,679 4/1977 Kemner et al. ..... 378/98.2
4,881,124 11/1989 Yokouchi et al. ..... 378/99
4,901,336 2/1990 Nishiki .

OTHER PUBLICATIONS

"State-of-the-Art and Development Tendencies of X-ray Image Intensifier Television Systems," Pfeiler et al., Electromedica (May 1975), pp. 148-157.

*Primary Examiner*—Craig E. Church
*Attorney, Agent, or Firm*—Hill, Steadman & Simpson

[57] ABSTRACT

An x-ray diagnostics installation for intermittent fluoroscopy of an examination subject has an x-ray tube, supplied by a high-voltage generator, an x-ray image intensifier video chain with an image pick-up unit, and control logic for the high-voltage generator and for the video chain which controls the high-voltage supply to continuously operate x-ray tube and which controls read out of the pick-up unit so that the read out is pulsed or intermittent. Read out of the pick-up unit is suppressed for a number of potentially available images, and image playback ensues in the manner of a stroboscope. The high-voltage supply can then be set to values such that the x-ray dose rate of the x-ray tube is lower than the dose rate which is normal for standard fluoroscopy.

6 Claims, 2 Drawing Sheets

X-RAY DIAGNOSTICS INSTALLATION FOR INTERMITTENT TRANSILLUMINATION

This is a continuation of application Ser. No. 08/032,092, filed Mar. 17, 1993.

BACKGROUND OF THE INVENTION

1. Field of the Invention

The present invention is directed to an x-ray diagnostics installation for fluoroscopic examination of a subject, of the type wherein x-ray images of the examination subject are intermittently generated.

2. Description of the Prior Art

A fluoroscopic diagnostics installation wherein x-ray images of an examination subject are intermittently generated is disclosed in German OS 30 40 425. This known installation includes an x-ray tube connected to a high-voltage generator, and has an x-ray image intensifier video chain with a pick-up unit, and control logic for operating the high-voltage supply and the x-ray image intensifier video chain. The control logic operates the high-voltage supply so that the x-ray tube emits x-rays at an increased dose rate, however, the x-ray tube output is pulsed by the control logic, so that the overall dose to which the examination subject is exposed is reduced. Intermittent x-ray images are thereby generated, which are sampled by the video pick-up unit and are stored in an image memory. The current image stored in the image memory is then reproduced with standard video frequency until a new x-ray pulse causes the generation of a new image after, for example, five clock pulses. The new image is then overwritten into the image memory. The dose per individual image is thus maintained constant but, for example, only every fifth individual image is used to generate a displayed image, with the scan beam of the video pick-up tune being disenabled in the interim. Particularly given low pulse frequencies, this results in a stroboscopic effect in the displayed image, however, this effect can be accepted in view of the advantage of the reduced dose. In order to achieve a flicker-free reproduction of the images, the image memory can be switched to a so-called "gap filling" mode, wherein the current content of the image memory is continuously read out.

Grid-controlled x-ray tubes can be used for generating pulsed x-rays, however, such x-ray tubes are substantially more costly than conventional x-ray tubes. In a technique known as primary pulsing, the high-voltage supply for the x-ray tube is operated in a pulsed manner, however, in order to achieve sufficiently steep leading and trailing pulse edges, extremely rapid rise and decay times must be achieved, which are difficult to obtain in the context of the high-voltages of the type needed for operation of the x-ray tube. This results in a complicated overall structure of the x-ray generator. Both of the above techniques for intermittent fluoroscopy, however, have the disadvantage that the x-ray tube is operated with a high filament current, or a high anode current, which has a deteriorating effect on the useful life of the tubes.

An article in the periodical "Electromedica" (5/75), at pages 148–157 discusses the use of the integrating effect of video pick-up tubes for the purpose of producing individual x-ray exposures. After the injection of a bolus of contrast agent into an examination subject, and using an unchanging dose rate, the beam current of a video pick-up tube is interrupted for half a second, so that the light incident on the video tube target can be correspondingly integrated. The image is subsequently read out and stored, so that the stored picture can be reproduced immediately thereafter. The long integration time serves the purpose, for example, of ensuring that the complete information corresponding to the entire course of a contrast agent bolus is included in the integrated image. This technique and circuitry, however, cannot be employed in a fluoroscopic mode.

An x-ray diagnostics installation is disclosed in German OS 38 42 649 having a solid-state image pick-up unit for producing static x-ray shadowgraphs. Read-out of the signals is prevented during irradiation of the subject by x-rays with a normal dose rate, so that an integration ensues. Subsequently, the x-ray generator is switched off, and the optically stored x-ray images are transferred into an electronic memory. Again, however, this known apparatus only serves the purpose of generating a static exposure, and cannot be employed for fluoroscopy.

SUMMARY OF THE INVENTION

It is an object of the present invention to provide an x-ray diagnostics installation of the type permitting intermittent video fluoroscopy of an examination subject, which enables an economic structure of the x-ray system and preserves the useful life of the x-ray tube.

The above object is achieved in accordance with the principles of the present invention in an x-ray diagnostics installation having control logic for operating the high-voltage supply of the x-ray tube continuously, and for controlling read-out of the pick-up unit in an intermittent pulsed mode, so that read-out of the pick-up unit is suppressed for a number of images, and the image reproduction ensues in the manner of a stroboscope, and wherein the high-voltage supply for the x-ray tube can be set to values for generating a dose rate which is lower in comparison to standard fluoroscopy. The x-ray generator is thus constantly operated, as in normal fluoroscopy, but is switched to lower dose rate values without a loss in image quality. As a result of the operation of the pick-up unit in a pulsed mode, integration of the x-ray image ensues on the light-sensitive surface of the pick-up unit. This integrated image is then scanned after a time and is read out and stored in an image memory, so that it can be repeatedly reproduced on a monitor. After the scanning has been completed, the pick-up unit is again blanked for a plurality of images, so that an integration over the time span of this plurality of individual images can again ensue on the light-sensitive surface of the pick-up unit. As a result, images of an extremely high quality with a low noise component are obtained. A reduction in the radiation load on the examination subject is additionally achieved due to the lower values of dose rate values. The number of images for which read out is suppressed or blanked can be made selectable by providing the control logic with means for setting the number of images for which read out is to be suppressed. The radiation Icad on the patient can be reduced in a simple manner by coupling the control logic to the x-ray generator so that, when the setting means varies the spacing of the pulses for controlling the read out of individual images, the dose rate is automatically correspondingly varied, so that the dose rate is constant per individual image. The pick-up unit may be, for example, a video camera, a CCD converter, or an image intensifier having an integrated semiconductor transducer.

DESCRIPTION OF THE PREFERRED EMBODIMENTS

Figure 1:
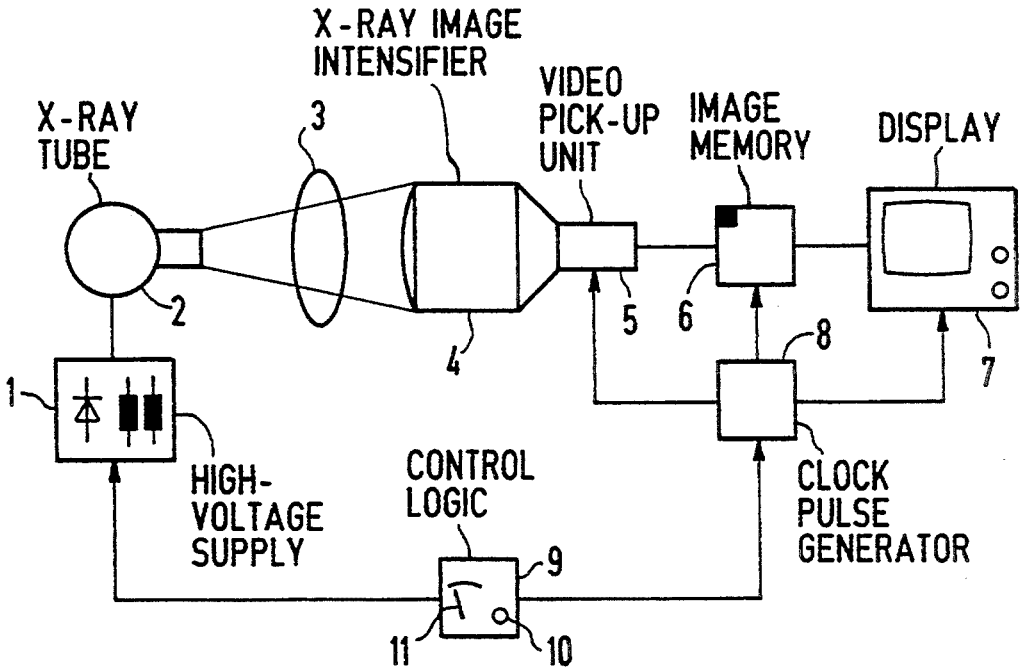
FIG. 1 is a schematic block diagram of an x-ray diagnostics installation constructed in accordance with the principles of the present invention.

The x-ray diagnostics installation shown in FIG. 1 has an x-ray generator formed by a high-voltage supply 1 and an x-ray tube 2, which generates an x-ray beam which penetrates a patient 3. The x-ray beam is attenuated in accordance with the transparency of the patient 3 and is incident on the input luminescent screen of an x-ray image intensifier 4. The output screen of the x-ray image intensifier 4 is coupled to an image pick-up unit 5 for converting the x-ray image into an electrical signal sequence. The pick-up unit 5 is part of a video chain which includes an image memory 6 and display monitor 7. A clock generator 8 is part of control means for controlling and synchronizing the signals for the video chain. This control means also includes control logic 9, connected both to the high-voltage supply 1 and to the clock generator 8 for operating those components as described below. The control logic 9 includes a switch 10 for switching a conventional fluoroscopic mode to a pulsed video fluoroscopic mode. The control logic 9 also includes setting means 11 for setting the desired pulse spacing in the pulsed video fluoroscopic mode.

Figure 2:
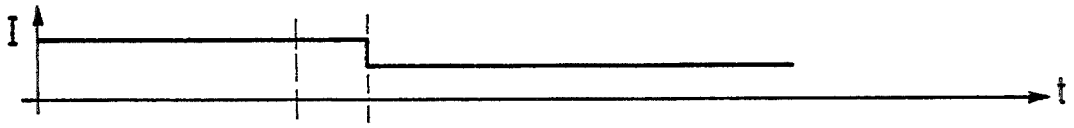
FIGS. 2 through 5 respectively show curves of signals arising in the operation of the control logic in the installation shown in FIG. 1.
Figure 3:
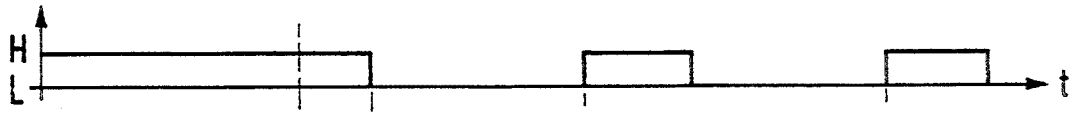
Figure 4:
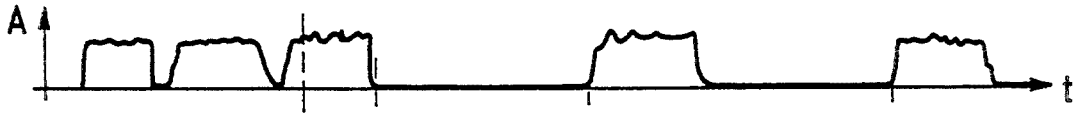

The operation of the control means is further explained on the basis of the signals respectively shown in FIGS. 2 through 5. In FIG. 2, the intensity I of the x-radiation is entered over time. The blanking of the pick-up unit 5 is shown in FIG. 3, with standard scanning taking place in the presence of signals at a high level H, with the scan beam being inhibited (blanked) in the presence of low-level signals L, given a video pick-up tube as the pick-up unit 5. If a CCD converter is employed as the pick-up unit 5, only the clock pulses for the read-out need be inhibited. The BAS output signal A of the pick-up unit 5 is shown in FIG. 4, and the BAS output signal B of the image memory is shown in FIG. 6.

Figure 5:
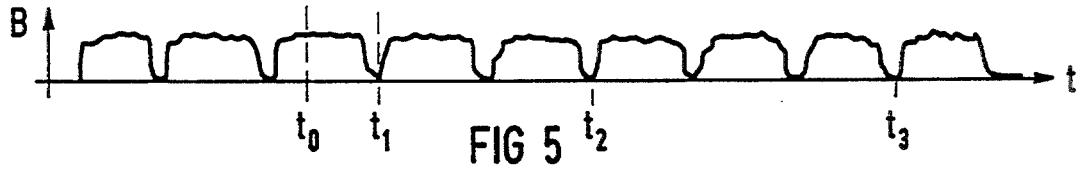

As may be seen in FIG. 2, the x-ray tube 2 is driven by the high-voltage supply 1 so that it generates x-ray beams having a defined intensity I. Because the blanking signal in FIG. 3 is initially at a high level, scanning takes place in the pick-up unit 5, so that a BAS signal A is generated as shown in FIG. 4, composed of a plurality of successive individual images. As shown in FIG. 5, these individual images are either intermediately stored in the image store 6 for image processing in order, for example, to implement an electrical integration, or are directly reproduced on the monitor 7.

When the switch 10 is actuated at time $t_o$, switching of the x-ray diagnostics installation to the intermittent fluoroscopic mode can be effected either immediately or, as shown in FIGS. 2 through 5, at time $t_1$. Preferably, the actual switch over takes place synchronized with the completion of a scan of an individual image. This is the case at time $t_1$. As can be seen in FIG. 2, the x-radiation is automatically switched to a lower intensity I. The output signal in FIG. 3 drops to the low level L, so that the scan beam of the video pick-up tube serving as the pick-up unit 5 is inhibited. As a result, no video signal A (FIG. 4) is present at the output of the pick-up unit 5. The signal previously stored in the image store 6, however, is immediately read out and is reproduced on the monitor 7, as shown in FIG. 5.

The inhibiting can continue over an arbitrary number of individual images. The spacing of the individual pulses which determine the inhibiting can be selected by the setting means 11. Preferably, this spacing is set between 5 through 10 individual images. In specific applications, however, an integration time over a time of less than 5 or more than 10 individual images may be desirable. A shorter value results only in a slighter reduction in the dose, whereas the visibility of a moving subject within the image is made more difficult at higher values. This is because the moving subject becomes blurred, as well as because the time span between the updated images is overly long. In the example shown in FIGS. 2 through 5, however, only every third individual image is registered. This has been selected in this example only for clarity. As used herein, therefore, a "low dose" of x-rays means a dose which is lower than the radiation dose to which a patient is subjected in conventional, non-intermittent fluoroscopy.

At time $t_2$, adequate integration has been undertaken on the light-sensitive surface of the pick-up unit 5, so that the pick-up unit 5 is enabled by the blanking signal reverting to the high level H, so that scanning again ensues and a video signal is again generated, as shown in FIG. 4. This new video signal is then stored in the image memory 6 and is read out for the following individual images during which the pick-up unit 5 is inhibited. At time t3, this process is repeated, the repetitions continuing until the x-ray diagnostics installation is again switched to the normal fluoroscopic mode by actuation of the switch 10.

If the dose per individual image is to remain constant, the setting means 11 for selecting the pulse spacing can be coupled to the high-voltage supply 1 so that the dose rate is correspondingly reduced given an increase in the pulse spacing.

This pulsed video fluoroscopy provides an x-ray diagnostics installation which, without significantly added outlay, can be operated both continuously and in a pulsed mode with low dose rate values. The combination of a certain exposure time with a "dose pulse" for specific, individual video images ensues simply by the blanking of the pick-up unit 5 for a certain time before the individual video images are read out. An arithmetic averaging of continuous radiation given constant irradiation of the subject is thereby achieved.

In conventional intermittent fluoroscopy, employing pulsed operation of the x-ray tube, motion phases are obtained only during the short time of the actual x-ray exposure, so that only a slight motion blurring in the images arises, but pronounced motion differences arise between two successively displayed images. In the intermittent video fluoroscopy in accordance with the invention, however, the entire motion phase between two successive read outs is stored, so that a "soft" transition of the motion phases is obtained, since the edges of the images do not exhibit large chronological offsets.

Blurring of fast movements of subjects, however, can be acceptable in many instances for employment in general angiography. Further, the x-ray diagnostics installation disclosed herein has a faster response time of the x-rays compared to conventional x-ray pulsing, corresponding to that of continuous radiation. Video cameras having a scan beam which is inhibited for blanking, or CCD converters externally or internally coupled to the x-ray image intensifier, can be employed as pick-up unit 5.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray diagnostics installation comprising:

an x-ray tube fed by a high-voltage supply for generating x-rays for fluoroscopic examination of a subject;

a video chain including image pick-up means for converting an optical x-ray image of said subject into a video signal sequence, by integrating said optical x-ray image, said video signal sequence consisting of a plurality of video images, and display means for displaying said x-ray image represented by said video images; and control means for, in a first mode, controlling operation of said high-voltage supply for continuously operating said x-ray tube to generate x-rays at a first intensity and for controlling operation of said video chain for reading out optical x-ray images, respectively integrated over first integration times, from said image pick-up means to obtain a plurality of successive video images supplied to said display means and for controlling display of said successive video images by said display means as displayed successive images each having an image duration, and, in a second mode, for controlling operation of said high-voltage supply for continuously operating said x-ray tube to generate x-rays at a second intensity, lower than said first intensity, said images pick-up means in said second mode integrating respective optical x-ray images generated at said second intensity over second integration times each of which is longer than any of said first integration times, and for controlling operation of said video chain for intermittently reading out said image pick-up means in a pulsed mode after a period of multiple image durations to obtain a plurality of intermittent video images supplied to said display means and for controlling display of said intermittent video images by said display means as displayed intermittent images each having the same image duration as said displayed successive video images.

2. An x-ray diagnostics installation as claimed in claim 1 wherein said control means includes setting means for selecting a number of image durations comprising said period of multiple image durations.

3. An x-ray diagnostics installation as claimed in claim 1 wherein said control means includes means for generating a pulse for effecting each read-out of a video image from said image pick-up, and setting means for selectively varying a spacing between pulses which define said period of multiple image durations and means, responsive to said spacing between said pulses, for automatically and correspondingly adjusting said high-voltage supply for maintaining a constant dose rate per x-ray image.

4. An x-ray diagnostics installation as claimed in claim 1 wherein said pick up means comprises a video camera.

5. An x-ray diagnostics installation as claimed in claim 1 wherein said pick-up means comprises a CCD converter.

6. An x-ray diagnostics installation as claimed in claim 1 wherein said video chain includes an x-ray image intensifier having an integrated semiconductor transducer.

* * * * *